US007997105B2

(12) United States Patent
Hill et al.

(10) Patent No.: US 7,997,105 B2
(45) Date of Patent: Aug. 16, 2011

(54) PUSH-POSITION INDICATOR FOR APPLIANCE DOOR

(75) Inventors: Chris H. Hill, Ames, IA (US); Douglas C. Norman, Webster City, IA (US); Jason Schott, Webster City, IA (US); Reynaldo Nadolny, Webster City, IA (US); Brian D. Ripley, Webster City, IA (US)

(73) Assignee: Electrolux Home Products, Inc., Cleveland, OH (US)

( * ) Notice: Subject to any disclaimer, the term of this patent is extended or adjusted under 35 U.S.C. 154(b) by 422 days.

(21) Appl. No.: 12/164,660

(22) Filed: Jun. 30, 2008

(65) Prior Publication Data

US 2009/0320371 A1 Dec. 31, 2009

(51) Int. Cl.
*D06F 37/28* (2006.01)

(52) U.S. Cl. ..... 68/196

(58) Field of Classification Search ..... 89/196; 134/200

See application file for complete search history.

(56) References Cited

U.S. PATENT DOCUMENTS

| | | | | |
|---|---|---|---|---|
| 3,991,520 | A | 11/1976 | Graham | |
| 6,679,572 | B2 | 1/2004 | Sears | |
| 6,861,604 | B2 * | 3/2005 | McSwiggen | 200/520 |
| 7,347,460 | B2 * | 3/2008 | Ala | 292/216 |
| 7,363,781 | B2 * | 4/2008 | Erickson | 68/196 |
| 2006/0033346 | A1 | 2/2006 | Ala | |

FOREIGN PATENT DOCUMENTS

| | | | |
|---|---|---|---|
| CA | 2091941 | * | 9/1994 |
| FR | 2 552 458 | * | 3/1985 |
| GB | 2 081 858 | * | 8/1980 |
| GB | 2 207 180 | * | 1/1989 |
| GB | 2 302 760 | * | 1/1997 |
| JP | 63-200799 | * | 8/1988 |
| JP | 2005-348923 | * | 12/2005 |
| JP | 2006-181019 | * | 7/2006 |
| JP | 2007-111108 | * | 5/2007 |
| KR | 2003004713 | * | 1/2003 |

OTHER PUBLICATIONS

European Patent Office 0 533 635 Mar. 1993.*
European Patent Office 0 976 863 Feb. 2000.*
WIPO WO 2006/072904 Jul. 2006.*
U.S. Appl. No. 11/944,032, filed Nov. 21, 2007, entitled: "Laundry Appliance Over-Molded Metal Porthole Door Frame".

* cited by examiner

*Primary Examiner* — Frankie L Stinson
(74) *Attorney, Agent, or Firm* — Banner & Witcoff, Ltd.

(57) ABSTRACT

A push-push appliance door, e.g., for a front-load automatic laundry washer, includes a peripheral frame having a first cut-out configured to receive a push-position indicator member that designates a push-position for opening the door. The frame may include a second cut-out located on an opposite side of the frame from the first cut-out. The door may further include a cut-out filler piece. The first and second cut-outs may be configured to interchangeably and interlockingly receive the indicator member and the cut-out filler piece, to thereby allow the indicator member to be properly positioned in relation to a selection of a hinge/latch location.

25 Claims, 7 Drawing Sheets

PUSH-POSITION INDICATOR FOR APPLIANCE DOOR

FIELD OF THE INVENTION

The present invention relates generally to appliance doors, and particularly to features facilitating user operation (i.e., opening and closing) of appliance doors.

BACKGROUND

In a modern trend, laundry appliances are taking on a more visually prominent role in the home, serving as statement pieces reflecting individual style. Consequently, the aesthetics of the laundry appliance is an important factor in the design of a laundry appliance and its components. Relatedly, greater emphasis is being placed on the "look and feel" of the operation features of laundry appliances. The access door of the laundry appliance is just such a feature, which is also very visually prominent.

Co-pending commonly owned U.S. application Ser. No. 11/944,032, filed Nov. 21, 2007, and titled "Laundry Appliance Over-Molded Metal Porthole Door Frame," incorporated by reference in its entirety herein, discloses a multi-component laundry appliance door assembly suitable for use with front-load washers and dryers. The door assembly includes an inner frame, an outer frame, an interior window mounted between the inner and outer frame, and an exterior window pane, that can be used to provide a sleek and uncluttered, contemporary appearance. A hinge is mounted to one side of the door assembly and a latch is mounted to the opposite side of the door assembly. The portions of the door assembly visible from the exterior of the laundry appliance, i.e., the exterior window pane and the outer frame could be formed identically for the dryer and for the washer, thereby providing aesthetically pleasing and matching exteriors of the dryer door assembly and the washer door assembly.

Limited use has been made of push-push latch mechanisms in door assemblies for laundry appliances. U.S. Pat. No. 6,679,572 discloses a laundry appliance of the top load variety that can be opened by a person pushing on the door to release a push-push latch. Push-push door assemblies can be used to aesthetically pleasing effect, in that the exterior surface of the door need not be encumbered with operation hardware. This may lead, however, to confusion on the part of users regarding the manner in which the door is to be opened, especially if the hinge and latch locations of the door are subject to change, such as is the case with the door assembly described in aforementioned U.S. application Ser. No. 11/944,032.

The capability to switch a front-load laundry appliance door from a left-opening door (i.e., a door with the hinge on the right and the latch on the left) to a right-opening door (i.e., a door with the hinge on the left and the latch on the right) is an advantageous feature that is generally known. Such interchangeably mountable doors allow the consumer to provide the best opening set up for their specific washer/dryer configuration. However, such interchangeability can exacerbate the potential for user confusion if the appliance door employs a push-push mechanism and is provided with a sleek, unencumbered exterior surface. A press on the wrong side (e.g., the hinge side) of the door may be ineffective to open the door or require excessive force. In such a situation, a consumer may appreciate having an indication as to the optimal location to push to open the door. A simple mark, such as a decal, embossment or adhesively applied button or the like could be used, except that such an arrangement may detract from the aesthetics of the appliance and may not have the durability to last, especially given the potential for exposure to chemicals that may be used in conjunction with a laundry washer.

Thus, an appliance door assembly that would facilitate the use of a push-to-open, push-to-close latch by providing a robust indication to a user as to where to push to open the door, while at the same time permitting a sleek, unencumbered, aesthetically-pleasing look to be achieved through the use of the push-push mechanism, would be highly beneficial. Additional substantial benefit would be realized by a configuration facilitating ready interchangeability of the indicator depending upon the selected interchangeable positions of the hinge and latch of the door.

BRIEF SUMMARY OF SELECTED INVENTIVE ASPECTS

In accordance with an aspect of the invention, an appliance door assembly having a door structure and an indicator member is provided. The door structure includes a first cut-out that is configured to receive the indicator member. The indicator member is receivable within the cut-out, and when mounted in the first cut-out, the indicator member is visible on a front of the door structure so as to designate a push-position for opening the door.

The indicator member may be interlockingly removably mounted to the door structure within the first cut-out. The door structure may further include a second cut-out also configured to removably interlockingly receive the indicator member.

The door assembly may include a filler piece configured to be interlockingly removably fit within the first and second cut-outs interchangeably with the indicator member.

In one aspect, the door assembly may include a hinge structure attached to a first peripheral side of the door structure, and further may include a latch element attached to a second peripheral side of the door structure. The hinge structure and the latch structure may be interchangeably positionable on the door structure.

In another aspect, the door assembly may include a peripheral frame having the first cut-out. The frame may further include the second cut-out located on an opposite side of the frame from the first cut-out and configured to removably receive the indicator member.

The indicator member may include a visual indicator portion and an indicator mounting base configured to hold the visual indicator portion. The mounting base may be configured to be snap-fit mounted to the frame. One of the indicator member and the frame may include a projection and the other may include an engagement element configured to elastically, interlockingly engage the projection.

The frame may include an inner wall and a front surface and the first cut-out may include a cut-out portion located in the inner wall. The frame may include an inner wall and a front surface and the first cut-out may include a cut-out portion located in the front surface.

In a further aspect, the indicator member includes a visual indicator portion, wherein the visual indicator portion has an indicator surface finish, wherein the frame has a frame surface finish, and wherein the indicator surface finish is more light reflective than the frame surface finish. The visual indicator portion may have a generally concave central region and a beveled outer edge.

In still another aspect, the door assembly may include an exterior window pane that extends over the indicator member. The indicator member may include a generally disk-shaped visual indicator portion spaced from the interior surface of the exterior window pane when the indictor member is received by the first cut-out.

In another aspect of the present invention, an appliance having a housing and an appliance door assembly is provided. The housing defines an interior chamber and an access opening to the chamber. The appliance door assembly may have a structure as set forth above.

The appliance may be a front-load laundry appliance.

According to a further aspect of the present invention, a method for changing the mount of an appliance door to an appliance cabinet is provided. The appliance door has a hinge structure, a latch structure, first and second cut-outs configured to interchangeably receive a push-position indicator member. The method includes interchanging the mount location of the latch structure and the hinge structure, and interchanging the mount location of the push-position indicator member from one to the other of the first and second cut-outs, so as to place the indicator member in closer proximity to the latch structure than the hinge structure.

The above and other objects, features and advantages of the present invention will be readily apparent and fully understood from the following detailed description of preferred embodiments, taken in connection with the appended drawings.

DETAILED DESCRIPTION OF EXEMPLARY EMBODIMENTS

Figure 1:
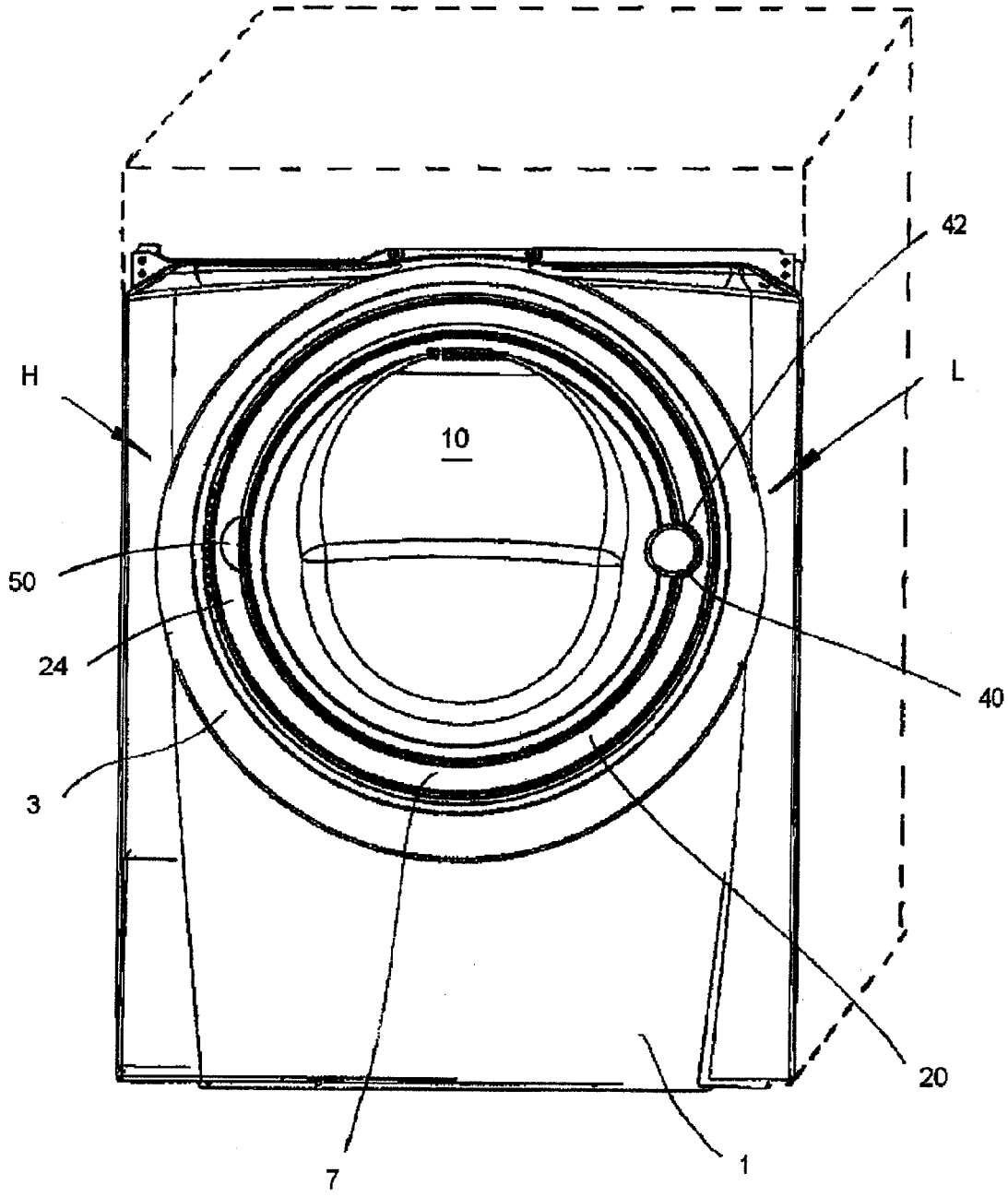
FIG. 1 is a front perspective view a laundry appliance including an access door provided with a push-position indicator in accordance with an aspect of the present invention.
Figure 2:
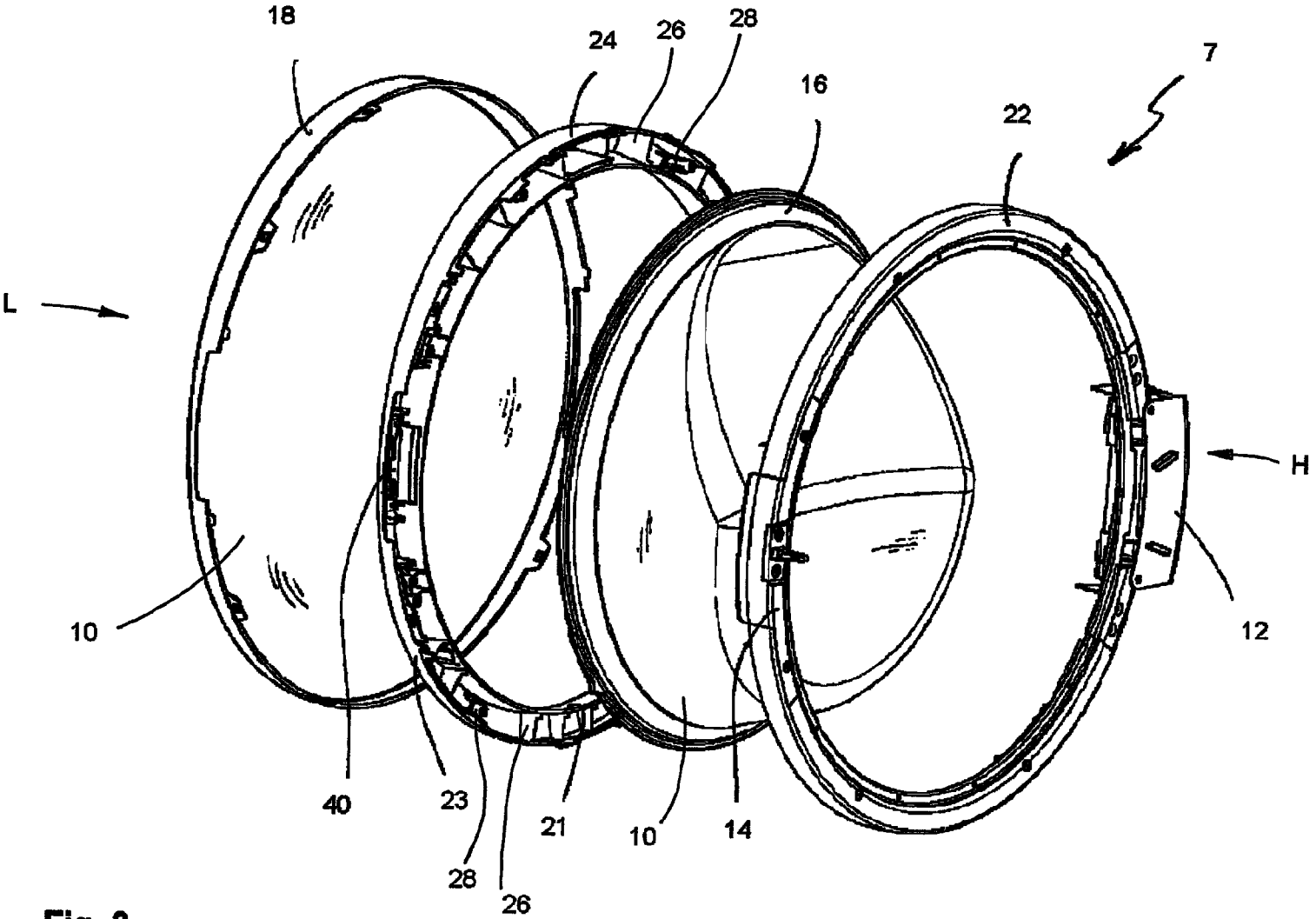
FIG. 2 is an exploded perspective view of one embodiment of the laundry appliance door frame assembly seen in FIG. 1.

Referring to FIG. 1, a front-load laundry appliance includes a front panel or bulkhead 1 to which is mounted a hinged laundry appliance door 7 that may be swung open to provide front-load access to a rotatable drum-type chamber, through a porthole 3. As illustrated in FIG. 1, the laundry appliance may be a front-load washing machine. Alternatively, the laundry appliance may be a dryer. Laundry appliance door 7, illustratively provided in the form of a circular porthole cover, includes a central see-through window portion 10 and a surrounding circumferential door frame assembly 20. Laundry appliance door 7 has a hinge side H and a latch side L. As best shown in FIG. 2, hinge structure 12 is located on hinge side H and latch structure 14 is located on latch side L of door 7.

Referring back to FIG. 1, laundry appliance door 7 is shown attached to appliance front panel 1 in a first hinge/latch configuration, wherein the hinge side H of laundry appliance door 7 is hingedly attached to the left side of access porthole 3. In this hinge/latch configuration, the latch structure is located to the right side of porthole 3, i.e., on the side L opposite the hinge side. In an alternative hinge/latch configuration (not shown), the hinge side H of laundry appliance door 7 may be on the right side of porthole 3. The latch structure would, in such case, be located to the left side of the porthole. In the illustrated embodiment, the latch structure comprises a push-to-open, push-to-close (push-push) latch. As such, the front surface of door 7 may be pressed to actuate an unlatching operation of the push-push latch. However, the effectiveness of the press in actuating the latch will vary widely depending upon the push position. A press directly over the latch will be most effective and require the least force. On the other hand, a press directly over the hinge point would be ineffectual or require excessive force, due to the small moment arm (displacement from the door's hinge axis). It may not be intuitively obvious where a user should push on the door to unlatch and open the door.

The door frame assembly 20 can facilitate hinge and latch reversibility by providing a seating and interlocking structure capable of mounting a hinge structure 12 and latch structure 14 in a reversible fashion on opposite sides of door frame assembly 20. Because the positions of hinge structure 12 and latch structure 14 may be switched from one side of door 7 to the other, and not be readily apparent (due to a construction that conceals these structures), the potential for confusion on the part of users regarding the optimal push-point is exacerbated. In accordance with the invention, this issue is alleviated by an indicator 42 that indicates where a user should push on the door to unlatch and open the door. Indicator 42 is shown in FIG. 1 positioned adjacent the latch side L. To accommodate a switch of hinge structure 12 and latch structure 14 from one side of door 7 to the other side, indicator 42 is also switchable from one side of door 7 to the other.

Referring to the exemplary embodiment shown in the exploded view of FIG. 2, laundry appliance door 7 includes an inner peripheral frame member 22 and an outer peripheral frame member 24. Hinge structure 12 and latch structure 14 are attached to inner frame member 22. Inner frame member 22 and outer frame member 24 may each be supplied as single or multiple piece components, and may be formed of various suitable materials. In one embodiment, inner frame member 22 is provided in the form of a multi-piece metal frame over-molded with plastic, as described in aforementioned commonly owned U.S. application Ser. No. 11/944,032. This may be particularly suitable when the door is associated with a dryer, due to its heat resistant structural properties. Alternatively, inner frame member 13 may be provided in the form of a single or multi-piece frame of molded plastic material. Outer frame member 24 may be provided in the form of a single or multi-piece frame of molded plastic material.

Central window portion 10 may include multiple window components. As shown in FIG. 2, central window portion 10 may comprise an interior component 16 and an exterior window pane or cap 18. Window components 16 and 18 may be formed of any suitable material, including transparent, translucent and/or tinted glass and/or plastic. Interior component 16 may be formed as a transparent porthole plug. Further, in certain embodiments, central window portion 10 may include an interior component 16 formed of a reflective, opaque or semi-opaque material and an exterior pane 18 formed of a transparent or translucent (tinted or clear) material. In other embodiments, central window portion 10 may include just a single window pane or cap.

As best shown in FIG. 2, interior window component 16 need not be planar, but may, for example, form a porthole plug structure that extends through inner frame member 22 toward the interior of the appliance. This exemplary embodiment is particularly suitable for use with a washing machine, wherein the plug protects the bellows located between the drum and the housing and further redirects the clothes back into the center of the drum as they are tumbled. Interior window component 16 may have a peripheral flange or shoulder portion that is mounted to surrounding inner frame member 22. Interior window pane 16 may be clamped or otherwise sandwiched between inner frame member 22 and outer frame member 24.

Exterior window pane or cap 18 is mounted over outer frame member 24. The cap structure of exterior window pane 18 extends over the edges of outer frame member 24 such that door 7 has a sleek, unencumbered appearance. Referring to the exemplary embodiment of FIGS. 1 and 2, exterior window pane 18 may be snap-fit onto outer frame member 24. The primary facing surface of exterior window pane 18 may be planar, arcuate, faceted, etc. In one embodiment, pane 18 could have a spherical surface or have another shape or profile.

Figure 3:
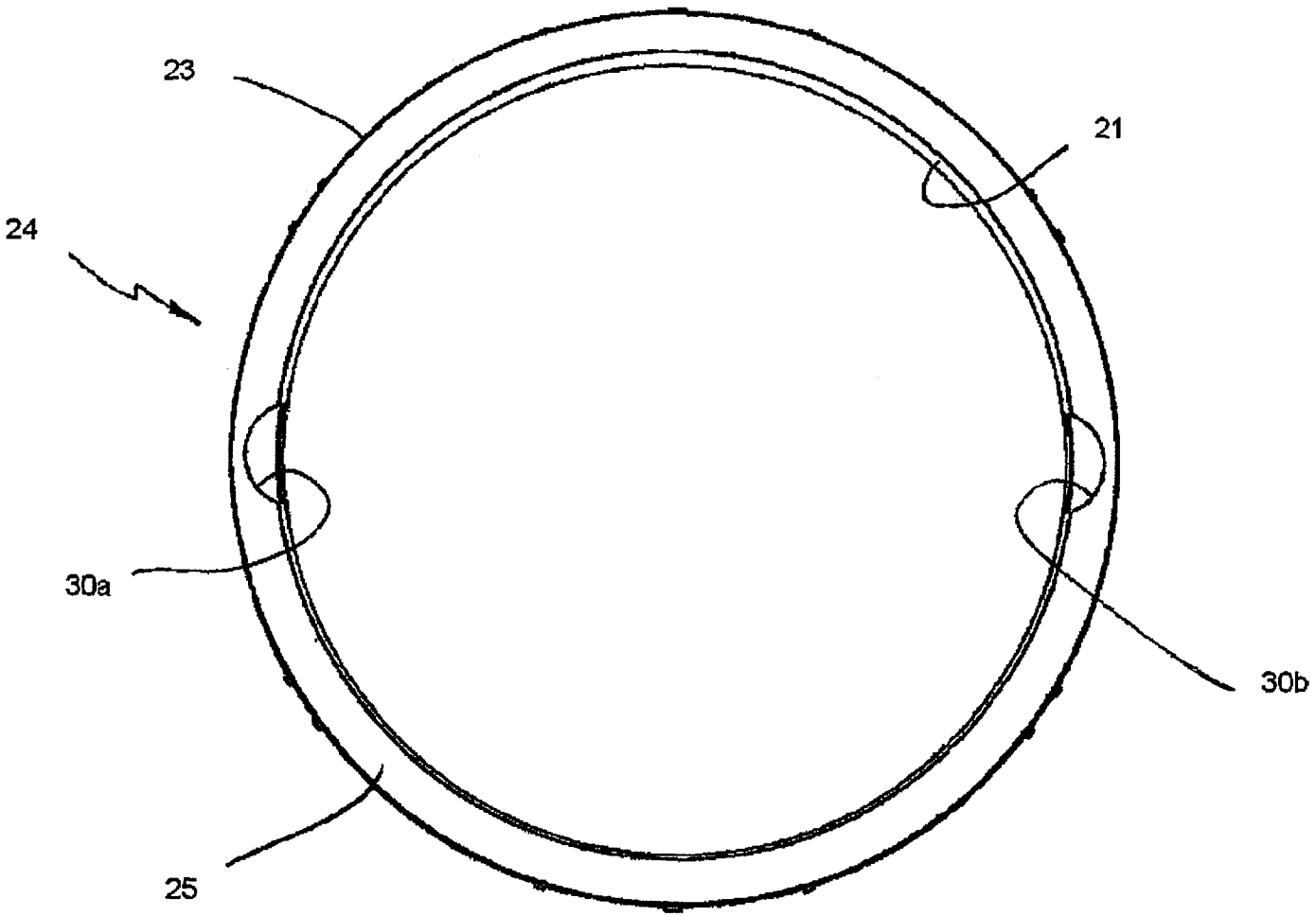
FIG. 3 is a front elevation view of a frame member of the laundry appliance door frame assembly seen in FIG. 2.

As illustrated in FIGS. 2 and 3, outer frame member 24 may be a molded piece comprising inner and outer diameter walls 21, 23 and a front face 25 forming an interior channel, cross-wise extending reinforcing ribs 26, and bosses 28 for attachment to inner frame member 22.

Figure 10:
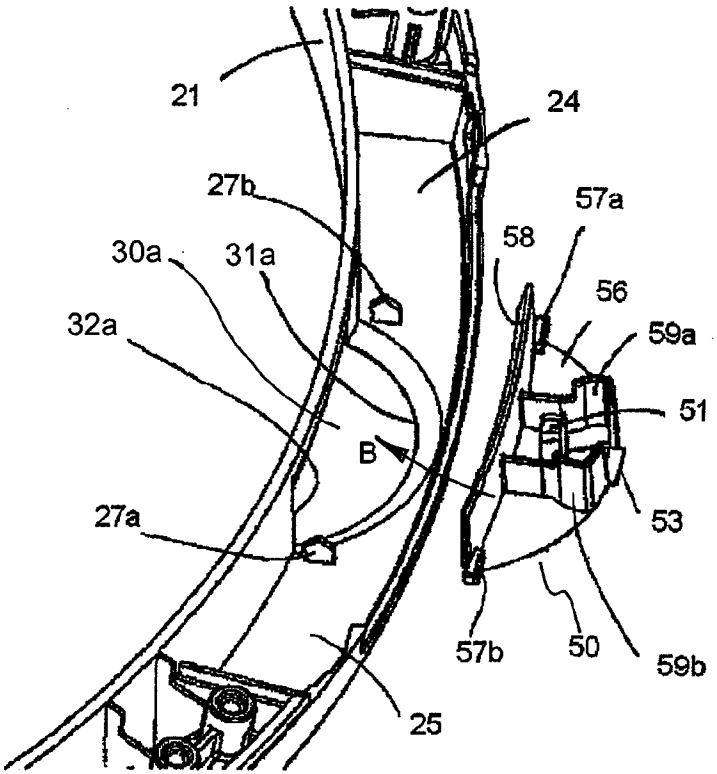
FIG. 10 is a partial perspective assembly view, from the back, of the cut-out filler and the frame member of FIG. 4.
Figure 8:
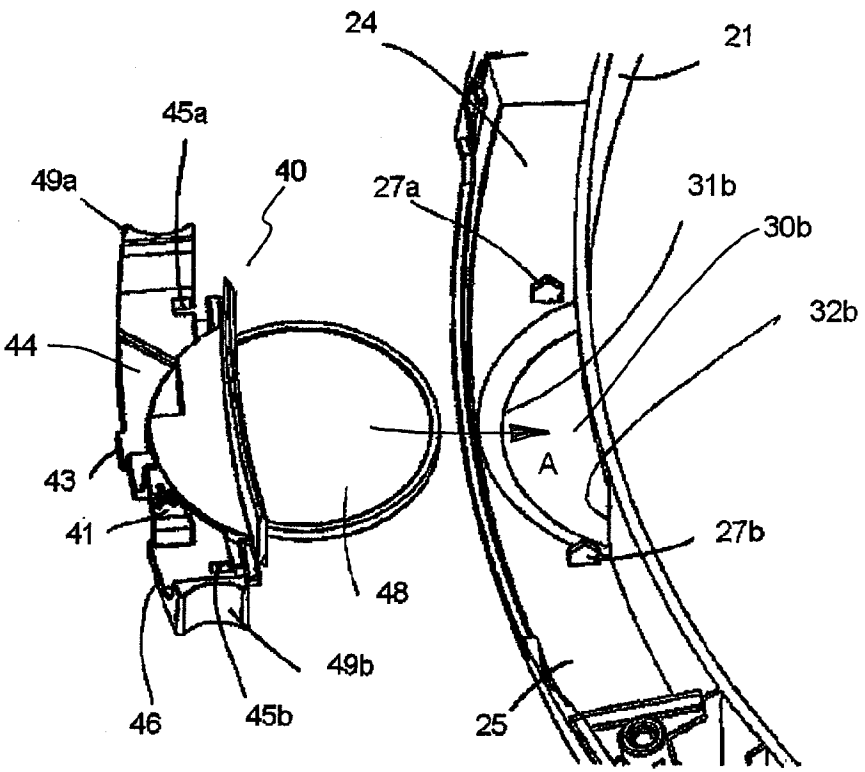
FIG. 8 is a partial perspective assembly view, from the back, of the push position indicator and the frame member of FIG. 4.

As best shown in FIG. 3, outer frame member 24 may include a first cut-out 30*a* and a second cut-out 30*b*. "Cut-out" as used herein refers generally to a reception void, cavity, recess, slot or the like, which may be molded or otherwise formed in a door or door frame structure. Cut-outs 30*a* and 30*b* are generally identical, being arranged in mirror-image relation to each other. With reference to FIGS. 3, 8 and 10, cut-outs 30*a* and 30*b* each include a cut-out portion 31*a*, 31*b* formed in front face 25 and a cut-out portion 32*a*, 32*b* formed in inner wall 21. In the exemplary embodiment of FIG. 3, cut-out portions 31*a*, 31*b* on front face 25 are generally semi-circular and cut-out portions 32*a*, 32*b* on arcuate inner wall 21 are generally rectangular. As will be described, these cut-outs are configured to interchangeably receive a push-position indicator assembly and a cut-out filler piece. Other cut-out shapes and configurations suitable for this purpose will be apparent to persons of ordinary skill in the art, given the benefit of the present disclosure.

Figure 6:
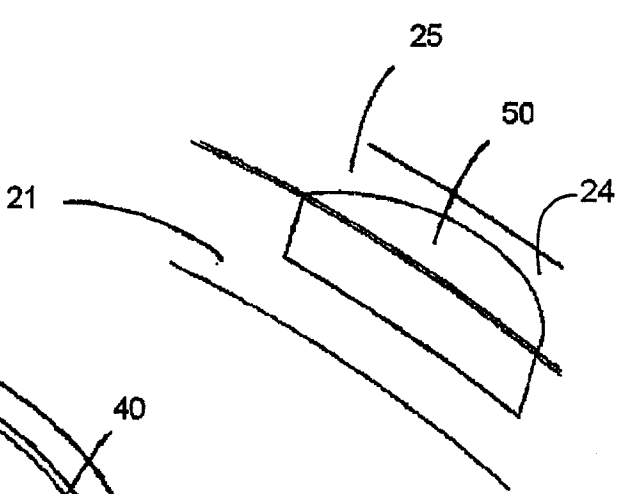
FIG. 6 is a partial perspective view, from the front, of the cut-out filler assembled with the frame member as presented in FIG. 4.
Figure 4:
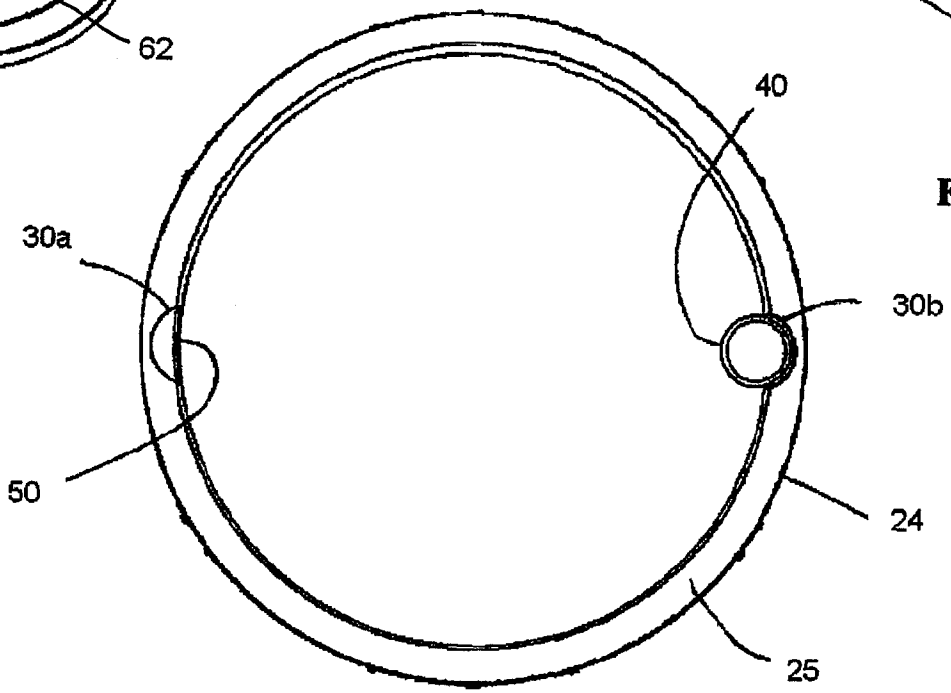
FIG. 4 is a front elevation view of the frame member shown in FIG. 3 assembled together with a push position indicator and a cut-out filler in accordance with as aspect of the invention.
Figure 5:
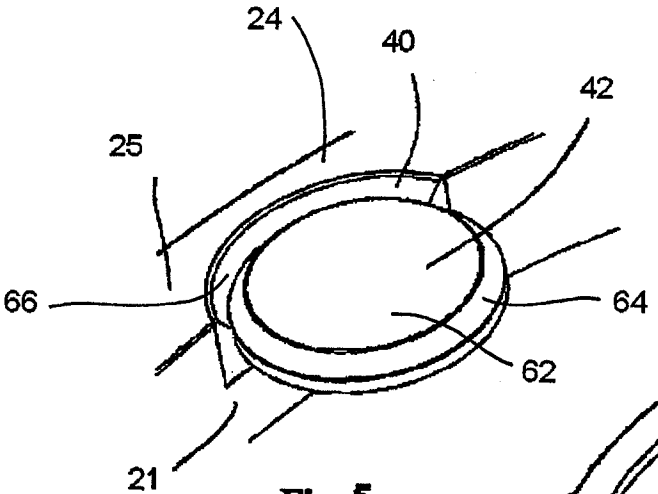
FIG. 5 is a partial perspective view, from the front, of the push position indicator assembled with the frame member as presented in FIG. 4.

Referring to FIGS. 4, 5 and 6, outer frame member 24 is shown with an indicator member 40 and a cut-out filler piece 50 installed thereon. In FIG. 4, indicator member 40 is shown received within second cut-out 30*b*. Cut-out filler piece 50 is received within first cut-out 30*a*. Alternatively, indicator member 40 may be received within first cut-out 30*a* and cut-out filler piece 50 may be received by second cut-out 30*b*. In other words, indicator member 40 and cut-out filler piece 50 may be interchangeably received within either cut-out 30*a* or cut-out 30*b*.

Figure 7:
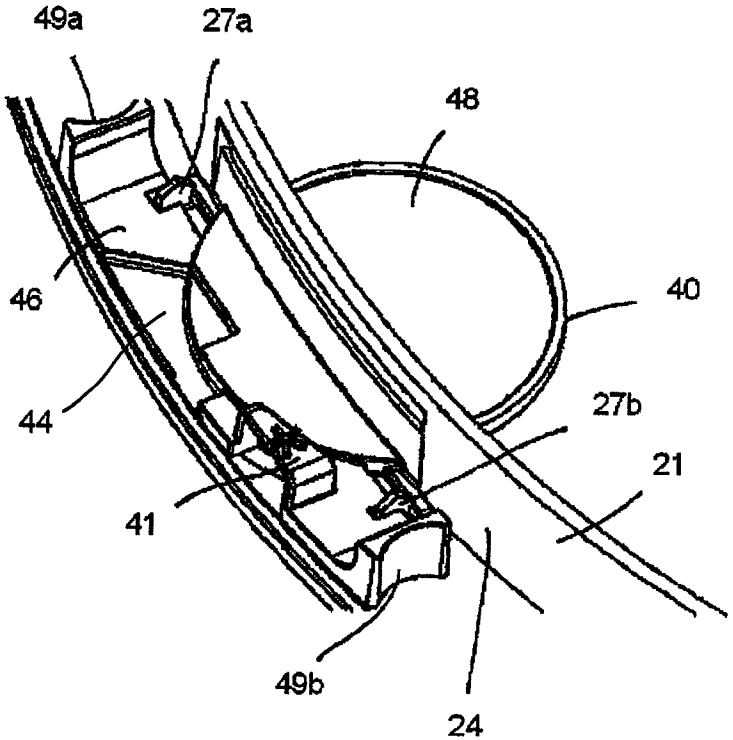
FIG. 7 is a partial perspective view, from the back, of the push position indicator assembled with the frame member as presented in FIG. 4.
Figure 11:
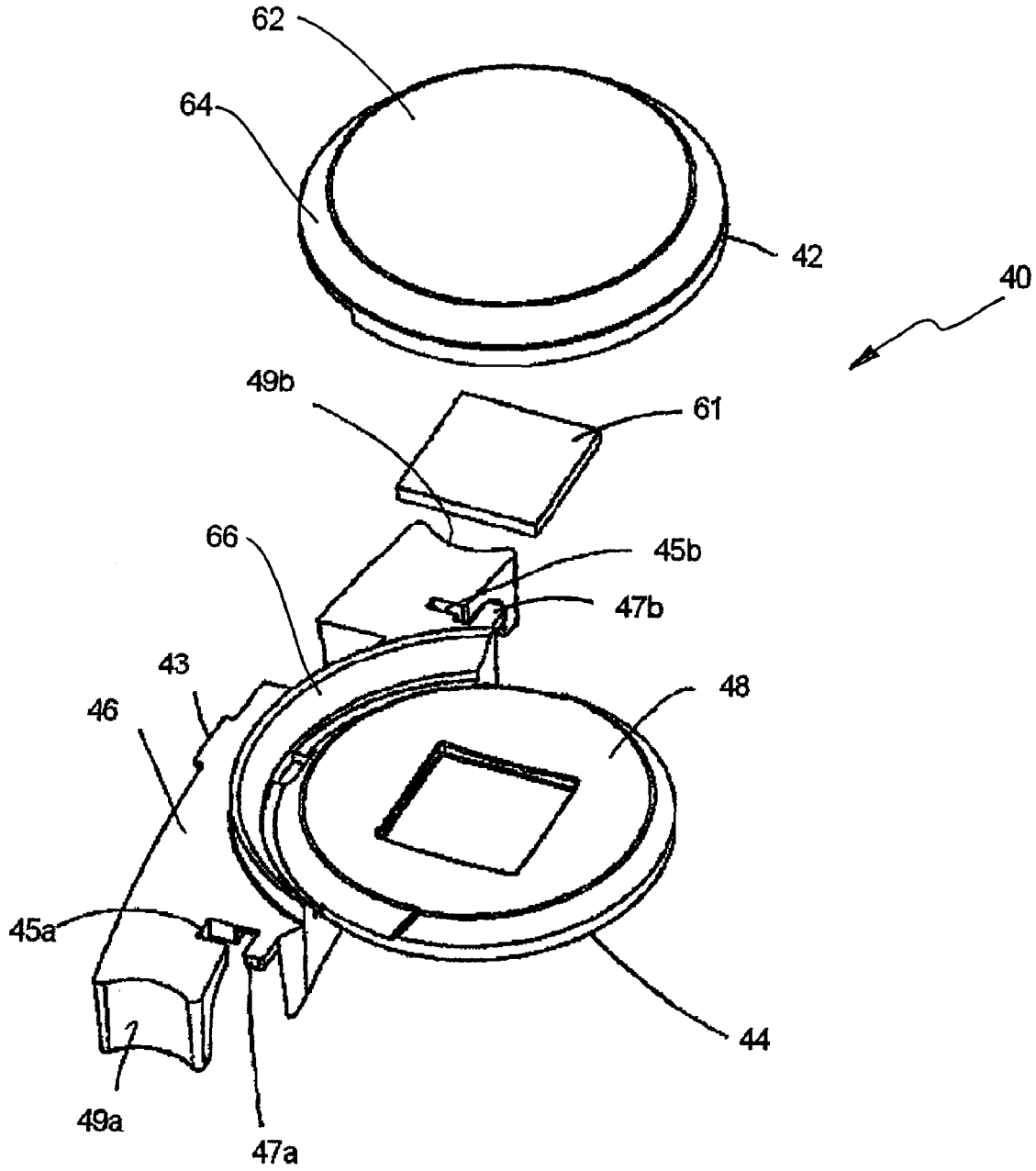
FIG. 11 is an exploded perspective view, from the front, of an embodiment of a push position indicator as presented in FIG. 5.

As best shown in FIGS. 7, 8 and 11, a mounting base 44 of indicator member 40 includes a frame-mounting portion 46 and an indicator-mounting portion 48. Indicator 42 is mounted to indicator-mounting portion 48. Indicator member 40 is received within one of the first or second cut-outs 30*a*, 30*b*, by insertion laterally (i.e., radially) inwardly into outer frame member 24, in the direction of arrow A in FIG. 8. Upon insertion, frame-mounting portion 46 is fitted within the channel of outer frame member 24. Frame-mounting portion 46 of indicator member 40 includes a three-point mounting system for removably retaining frame-mounting portion 46 within outer frame member 24, as seen in FIG. 7. Referring to FIG. 8, a tab 43 extends outwardly from a relatively centrally located portion on an outer edge of frame-mounting portion 46. Two slots 45*a*, 45*b* are formed on either side of indicator-mounting portion 48 and located adjacent an inner edge of frame-mounting portion 46. Slots 45*a*, 45*b* may be closed-bottom or open (through) slots. As shown in the embodiment of FIG. 11, slots 45*a*, 45*b* are open (through) slots, each having one edge formed by a tab 47*a*, 47*b*. Tabs 47*a*, 47*b* may elastically flex. These elements interengage with complimentary elements provided on outer frame member 24, as will be described.

Figure 9:
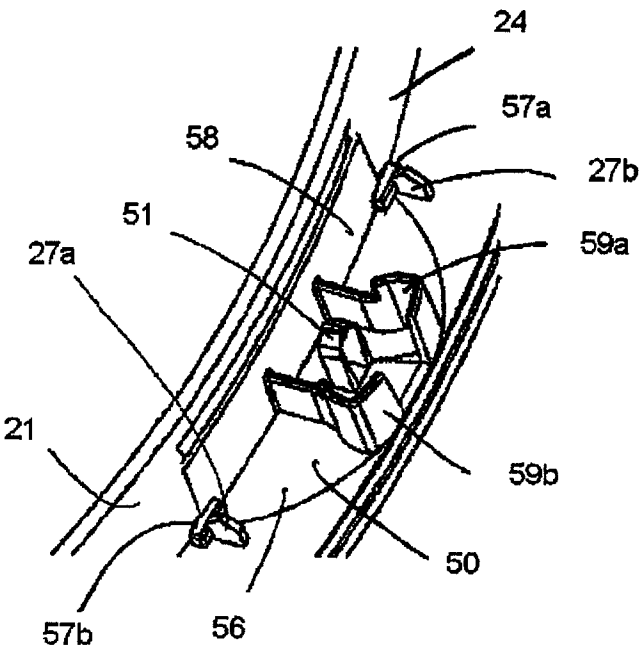
FIG. 9 is a partial perspective view, from the back, of the cut-out filler assembled with the frame member as presented in FIG. 4.

As best shown in FIGS. 9 and 10, cut-out filler piece 50 includes a frame-mounting portion 56 and a inner wall filling portion 58. Cut-out filler piece 50 is received within one of the first and second cut-outs 30*a*, 30*b*, laterally (i.e., radially) inwardly in the direction of arrow B, as seen in FIG. 10, in a manner generally similar to the insertion of indicator member 40. Upon insertion, frame-mounting portion 56 of cut-out filler 50 is fitted within the channel of outer frame member 24, as seen in FIG. 9. In the exemplary embodiment, frame-mounting portion 56 of cut-out filler 50 includes a three-point mounting system for retaining frame-mounting portion 56 to outer frame member 24, similar to indicator member 40. A tab 53 extends outwardly from a relatively centrally located portion on an outer edge of frame-mounting portion 56. Two tabs 57*a*, 57*b* are formed on the opposite circumferential ends of inner wall portion 58 and located adjacent the corner formed by the inner edge of frame-mounting portion 56 and inner (orthogonal) wall filling portion 58. Tabs 57*a*, 57*b* may elastically flex.

Outer frame member 24 includes a complementary three-point mounting system for retaining frame-mounting portion 46 of indicator member 40 to outer frame member 24 and for retaining frame-mounting portion 56 of cut-out filler 50 or outer frame member 24. At the outer edge of outer frame member 24, a slot or undercut in outer wall 23 of outer frame member 24 is configured to accommodate tab 43 of indicator member 40 and, interchangeably, to also accommodate tab 53 of cut-out filler piece 50. Generally adjacent to inner wall 21 of outer frame member 24, two projections 27*a* and 27*b* extend from an inner surface of front face plate 25. Projections 27*a* and 27*b* interact with tabs 47*a*, 47*b* and slots 45*a*, 45*b* to retain indicator member 40. Alternatively, indicator member 40 may be provided with projections and outer frame member 24 may be provided with complementary engagement elements, such that the projection and the engagement elements elastically and interlockingly engage one another.

To attach indicator member 40 to outer frame member 24, indicator mounting portion 48 is inserted through cut-out 30 from the back of inner wall 21, in the direction of arrow A as shown in FIG. 8. Indicator member 40 is then pivoted away from front surface plate 25 (and/or otherwise manipulated) such that tab 43 may be inserted into the slot at the outer edge of frame 24. Subsequently, pivoting of indicator member 40 toward front surface plate 25 causes tabs 47*a*, 47*b* to flex as they ride on the ramp surfaces of projections 27*a*, 27*b* and then interlockingly engage projections 27*a*, 27*b* with slots 45*a*, 45*b* in a snap fit. In this exemplary manner, indicator member 40 may be snapped into and out of releasable attachment with outer frame member 24, without the use of tools. Similarly, the slot at the outer edge of frame 24 accommodates tab 53 of cut-out filler piece 50 and projections 27*a* and 27*b* interact with tabs 57*a*, 57*b* of cut-out filler piece 50 such that cut-out filler 50 may be interlockingly engaged (snap fit) with outer frame member 24.

Indicator member 40 may further include finger grip members 49*a*, 49*b* providing contoured surfaces for facilitating grasping of the indicator assembly during assembly/disassembly with outer frame member 24. Similarly, cut-out filler piece 50 may also include finger grip members 59*a*, 59*b*.

To assist in retaining indicator member 40 smoothly against the front surface 25 of outer frame member 24, an elastically flexible biasing member 41 may be provided. When door frame assembly 20 is assembled, biasing member 41 may interact with an element of latch structure 14 (for example, a projection or pin) that presses on and deflects biasing member 41, thereby spring loading indicator member 40 against front surface 25. Thus, indicator-mounting portion 48 extends through cut-out 30*a*, 30*b* such that the top surface of indicator 42 is substantially flush with front face 25 of outer frame member 24. Further, a gap may be provided between indicator 42 and the inner surface of exterior window pane/cap 18. Base 44 of indicator member 40 may be formed of the same material as outer frame member 24. Thus, when indicator member 40 is attached to outer frame member 24, base 44 can blend into the top surface 25 of outer frame member 24, thereby creating the general visual appearance (especially with outer window pane/cap 18 overlaid) that frame member 24 and base 44 are unitary.

Similarly, cut-out filler piece 50 may be provided with an elastically flexible biasing member 51. When door frame assembly 20 is assembled, biasing member 51 may interact with an element of hinge structure 12 (for example, a projection or pin) that presses on and deflects biasing member 51, thereby spring loading cut-out filler piece 50 against front surface plate 25. The top surface of cut-out filler piece 50 is, thus, held substantially flush with the top surface of front surface 25 plate of outer frame member 24. When cut-out filler 50 and outer frame member 24 are formed of the same or visually similar material, cut-out filler 50 and outer frame member 24 in their assembled configuration will generally visually appear to be a contiguous single unit.

Indicator 42 is shown in FIGS. 5 and 11 as a generally flat, circular disk having a slight concavity in a central region 62 and a beveled outer edge 64. Alternatively, indicator 42 may have a flat or even a convex central region 62. Even further, the peripheral edge of indicator 42 need not be circular, but may have other regular or irregular shapes. As indicator 42 is provided for primarily visual purposes (as opposed to structural purposes), indicator 42 may be formed of various materials having the desired visual appearance, e.g., plastic, glass, metal, etc. The material/finish is preferably one that will withstand potential contact with the water detergent and other chemicals likely to be used for performing wash operations. As one example, indicator 42 may be provided as a chrome-plated plastic disk. As other examples, indicator 42 may be supplied with graphical and/or textured elements. Indicator 42 should be configured so that it is visible when viewed through exterior window pane 18 and against the background formed by the remainder of the door 7. Thus, for example, indicator 42 may have a surface finish that is relatively reflective and frame member 24 may have a surface finish that is relatively unreflective, such that indicator 42 visually stands out against the background of frame member 24. Further, indicator 42 may provide a means for interchangeably customizing door 7, i.e., a plurality of indicators of different aesthetic effect could be provided for being interchangeably mounted to indicator base 44.

Indicator 42 may be joined to base 44 in any suitable manner. In the particular embodiment shown in FIG. 11, indicator 42 is joined to base 44 with a square of double-sided adhesive tape or pad 61. Alternatively, indicator 42 and base 44 may be formed as a single unit. In such case, it may be desired to apply a coating to indicator 42, so as to visually distinguish indicator 42 from base 44.

Referring back to FIGS. 1 and 2, when door 7 is assembled, window pane 18 extends over outer frame member 24 and over indicator member 40 and cut-out filler 50 positioned within cut-outs 30*a*, 30*b* of outer frame member 24. In a preferred embodiment, outer frame member 24, cut-out filler piece 50 and base 44 of indicator assembly are all provided with the same or similar surface characteristics, to reduce or eliminate any visual contrasts between these components. Surface characteristics include color, texture, finish, material, reflectivity, etc. In a further preferred embodiment, indicator 42 is provided with a surface characteristic different than outer frame member 24, such that indicator 42 provides a high contrast with the surface of outer frame member 24. Additionally, referring to FIGS. 5 and 11, not only may indicator 42 include a beveled peripheral edge 64, but base 44 may also include a reversely beveled portion 66 located adjacent indicator 42. These neighboring reversely beveled features 64, 66 serve to create a visual separation between indicator 42 and base 44. In another preferred embodiment, exterior window pane 18 may be configured to provide an altered optical view through the pane, i.e., window pane 18 may be provided, e.g., with tinting or "lens-like" properties. These properties may be used to enhance the contrast between outer frame member 24 and indicator 42, thereby furthering an optical illusion that the indicator is "floating," i.e., unattached to the frame. To further enhance the "floating" effect, indicator 42 is spaced apart slightly from the interior surface of window pane 18, i.e., a small gap exists between indicator 42 and pane 18.

The present invention has been described in terms of preferred and exemplary embodiments thereof. Numerous other embodiments, modifications and variations within the scope and spirit of the appended claims will occur to persons of ordinary skill in the art from a review of this disclosure. For example, although particularly suitable for a push-push door of a laundry appliance, the present invention may be applied to doors or lids of other appliances or items. As another variation, the door, the frame members and/or the central pane members need not be circular. Further, the cut-outs in the frame, the cut-out filler piece and the indicator need not be circular or semi-circular. All examples, whether preceded by "for example," "such as," "including, or other itemizing terms or followed by "etc.," are meant to be non-limiting examples, unless otherwise stated or obvious from the context of the specification.

The invention claimed is:

1. A movable appliance door assembly comprising:

a door structure, said door structure including a push-push latch element and a first cut-out; and an indicator member receivable within said cut-out, wherein said first cut-out is configured to receive said indicator member and when mounted in said first cut-out said indicator member remains stationary and non-operational with respect to the door structure, is visible from a front of the movable door assembly, and designates a push-position for opening the movable door assembly via the push-push latch element.

2. The door assembly of claim 1, wherein said indicator member is interlockingly removably mounted to said door structure within said first cut-out.

3. The door assembly of claim 2, wherein said door structure further includes a second cut-out configured to removably interlockingly receive said indicator member.

4. The door assembly of claim 3, further including a filler piece configured to be interlockingly removably fit within the first and second cut-outs interchangeably with said indicator member.

5. The door assembly of claim 4, further including a hinge structure attached to a first peripheral side of said door structure, and further including a latch element attached to a second peripheral side of said door structure, wherein said hinge structure and said latch element are interchangeably positionable on said door structure.

6. The door assembly of claim 3, wherein said first and second cut-outs are provided in a peripheral frame of said door structure, and wherein said filler piece, when fit within one of said first and second cut-outs, forms a generally visually contiguous single unit with said peripheral frame.

7. The door assembly of claim 1, wherein said first cut-out is provided in a peripheral frame of said door structure.

8. The door assembly of claim 7, wherein said frame further includes a second cut-out configured to removably receive said indicator member, wherein said first and second cut-outs are located on opposite sides of said frame.

9. The door assembly of claim 7, wherein said indicator member includes a visual indicator portion and an indicator mounting base configured to hold said visual indicator portion and further configured to be snap-fit mounted to said frame.

10. The door assembly of claim 7, wherein one of said indicator member and said frame includes a projection and the other includes an engagement element configured to elastically, interlockingly engage said projection.

11. The door assembly of claim 7, wherein said frame includes an inner wall and a front surface, and wherein said first cut-out includes a cut-out portion located in the inner wall.

12. The door assembly of claim 7, wherein said frame includes an inner wall and a front surface, and wherein said first cut-out includes a cut-out portion located in the front surface.

13. The door assembly of claim 7, wherein said indicator member includes a visual indicator portion, wherein said visual indicator portion has an indicator surface finish, wherein said frame has a frame surface finish, and wherein the indicator surface finish is more light reflective than the frame surface finish.

14. The door assembly of claim 1, wherein said indicator member includes a visual indicator portion, said visual indicator portion having a generally concave central region and a beveled outer edge.

15. The door assembly of claim 1, further including an exterior window pane that extends over said indicator member.

16. The door assembly of claim 15, wherein said indicator member includes a generally disk-shaped visual indicator portion, and wherein a gap exists between said visual indicator portion and an interior surface of said exterior window pane when said indicator member is received by said first cut-out.

17. An appliance comprising:

a housing defining an interior chamber and an access opening to said chamber; and an appliance door assembly according to claim 1, mounted to said housing and movable between an open position and a closed position over said access opening.

18. The appliance of claim 17, further including a hinge structure hingedly attaching the door assembly to the housing, and further including a push-push latch structure for releasably retaining the door assembly in said closed position.

19. The appliance of claim 18, wherein said hinge structure and at least a portion of said push-push latch structure are interchangeably attachable to said door structure.

20. The appliance of claim 19, wherein said door structure further includes a second cut-out configured to removably receive said indicator member, wherein said first and second cut-outs are located on opposite sides of said door structure.

21. The appliance of claim 19, further including a filler piece configured to fit within the first and second cut-outs interchangeably with said indicator member.

22. The appliance of claim 19, further including an exterior window pane that extends over said indicator member, wherein said indicator member includes a generally disk-shaped indicator, and wherein a gap exists between said indicator and an interior surface of said exterior window pane when said indictor member is received by said first cut-out.

23. The appliance of claim 17, wherein the appliance is a front-load laundry appliance.

24. The door assembly of claim 1, wherein said indicator member, when mounted in said first cut-out, is generally located directly over said push-push latch element.

25. A movable appliance door assembly comprising:

a door structure, said door structure including a first cut-out;

an indicator member receivable within said cut-out, wherein said first cut-out is configured to receive said indicator member and when mounted in said first cut-out said indicator member is visible from a front of the movable door assembly so as to designate a push-position for opening the movable door assembly; and an exterior window pane that extends over said indicator member.

* * * * *

UNITED STATES PATENT AND TRADEMARK OFFICE

CERTIFICATE OF CORRECTION

PATENT NO. : 7,997,105 B2
APPLICATION NO. : 12/164660
DATED : August 16, 2011
INVENTOR(S) : Chris H. Hill et al.

It is certified that error appears in the above-identified patent and that said Letters Patent is hereby corrected as shown below:

Column 10, Line 36:

Please delete "indictor" and insert --indicator--

Signed and Sealed this
Twenty-fifth Day of October, 2011

David J. Kappos

David J. Kappos
*Director of the United States Patent and Trademark Office*